US005341193A

United States Patent [19]

Hubble, III et al.

[11] Patent Number: 5,341,193

[45] Date of Patent: Aug. 23, 1994

[54] METHOD AND APPARATUS FOR SENSING MAGNETIC SIGNAL STRENGTH OF XEROGRAPHICALLY DEVELOPED TONER IMAGES FOR CLOSED LOOP CONTROL OF MAGNETIC PRINTING

[75] Inventors: Fred F. Hubble, III, Rochester; Michael G. Swales, Sodus; Michael E. Weber; Gerald Abowitz, both of Penfield; Raphael F. Bov, Jr., Pittsford, all of N.Y.

[73] Assignee: Xerox Corporation, Stamford, Conn.

[21] Appl. No.: 659,556

[22] Filed: Feb. 22, 1991

[51] Int. Cl.[5] ..... G03G 21/00

[52] U.S. Cl. ..... 355/203; 118/712; 355/246; 360/128

[58] Field of Search ..... 355/200, 203, 210, 211, 355/212, 246; 118/688, 689, 712, 663, 665; 360/121, 122, 128

[56] References Cited

U.S. PATENT DOCUMENTS

| | | | |
|---|---|---|---|
| 4,097,910 | 6/1978 | Lafevers et al. | 360/126 |
| 4,545,066 | 10/1985 | Gascuel et al. | 382/11 |
| 4,563,086 | 1/1986 | Knapp et al. | 118/689 X |
| 4,924,263 | 5/1990 | Bares | 355/203 |

*Primary Examiner*—Lincoln Donovan
*Assistant Examiner*—Christopher Horgan
*Attorney, Agent, or Firm*—Kenyon & Kenyon

[57] ABSTRACT

A printing machine in which magnetically permeable marking particles develop a latent image recorded on a photoconductive member. A read head is positioned on the opposite of the photoconductive member to detect magnetic field intensity effects produced by the leading edge and the trailing edge of the marking particles on the characters recorded. The detected signals are used to control the magnetic quality of the developed image.

8 Claims, 16 Drawing Sheets

METHOD AND APPARATUS FOR SENSING MAGNETIC SIGNAL STRENGTH OF XEROGRAPHICALLY DEVELOPED TONER IMAGES FOR CLOSED LOOP CONTROL OF MAGNETIC PRINTING

BACKGROUND AND DISCUSSION OF THE INVENTION

The invention generally relates to a printing machine, and particularly those in which the quality of magnetic images is controlled. A desirable feature for printers and copying machines is the ability to write with magnetic toners. This feature is particularly useful in banking and financial industries where millions of transactions are performed each day with a high degree of automation enabled by machines that can read and recognize characters printed with magnetic ink.

In a typical electrophotographic printing process, a photoconductive member is charged to a substantially uniform potential so as to sensitize the surface thereof. The charged portion of the photoconductive member is exposed to a light image of an original document being reproduced. Alternatively, a raster output scanner generating a modulated light beam, i.e. a laser beam, may be used to discharge selected portions of the charged photoconductive surface to record the desired information thereon. In this way, exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Electrophotographic printing has been particularly useful in the commercial banking industry by reproducing checks or other financial documents with magnetic ink, i.e. by fusing magnetic marking or toner particles thereon. Each financial document has imprinted thereon encoded data in a magnetic ink character recognition (MICR) format. In addition, high speed processing of financial documents may be implemented by imprinting magnetic characters using CMC-7 font in machine readable form thereon. The repeated processing of the financial documents and the high speed sorting thereof is greatly simplified by the reading of the magnetically encoded MICR data. Thus, encoded information on financial documents may be printed with magnetic ink or toner. The information reproduced on the copy sheet with the magnetic particles may be subsequently read due to its magnetic characteristics. Hereinbefore, high speed electrophotographic printing machines have used magnetic toner particles for printing in the MICR format and non-magnetic toner particles for other types of printing. In either case, the toner particles have been subsequently transferred from the developed image to the copy sheet and fused thereto. Acceptable magnetic readability of the MICR text is a critical requirement for the printer. Hereinbefore, acceptable print characteristics have been maintained by conventional developability control schemes. However, the developability control either senses a developability surrogate, i.e. toner concentration, development current, etc., or senses a developed mass in the range where the sensor is sensitive, generally at intermediate solid area densities. The magnetic parameter level is inferred from surrogates at a risk of introducing uncertainties into the control loop and making the control band unacceptably wide. While the utilization of magnetically encoded information on documents reproduced with magnetic toner is well known, this information has not generally been used to control the processing stations of the printing machine or to continuously sense the developed image. Previously, light detectors have been used to measure the reflectivity of light rays reflected from the toner particles developed on the latent image or on a sample test patch. However, a light detector may lose sensitivity at higher toner mass coverage and may not be able to prevent overdeveloped images. In future products, it will be necessary to control copy quality for both magnetic and non-magnetic particles over a wide latitude in a reliable manner. The present invention provides such a technique.

Other approaches in monitoring or otherwise measuring the intensity of the magnetic field is explained in the patents which follow:

U.S. Pat. No. 4,563,086 discloses an electrophotographic printing machine using magnetic toner particles for reproducing copies with magnetic ink in a MICR format. After the toner image is fused to the copy sheet, it is magnetized and the intensity of the magnetic field measured by a read head adjacent the copy sheet. The output from the read head is processed by a logic circuit and converted into a control signal for regulating processing stations in the printing machine.

U.S. Pat. No. 4,372,672 describes a light source which produces light rays that are reflected from a toned sample test area to a phototransistor. The toned sample may be on the photoconductor or the copy paper. A circuit controls the density of the toned samples such that the reflectance ratio of the toned-to-untoned photoconductor remains constant. Density control is achieved by adjusting the toner concentration in the developer mix to maintain constant output copy density.

U.S. Pat. No. 4,312,589 discloses a light emitting diode which illuminates a toned patch and a clean area of a photoconductor. A photosensor detects the light reflected from the toned patch and clean area. The signal from the photosensor is processed and used to adjust charging of the photoconductor. When the photoconductor's charge magnitude has been increased to, or near, the working magnitude and the toned patch is of too low a density, additional toner is added to the developer.

U.S. Pat. No. 3,993,484 describes an electrostatic latent image recorded on a tape that is developed with magnetic toner particles. A magnetic image corresponding to the electrostatic latent image is formed on the tape. The toner particles are transferred to a copy paper and fused thereto. The magnetic image may be re-used, or it can be scanned and used to generate electrical images indicative of the information and the signals stored.

U.S. Pat. No. 3,858,514 discloses a magnetically encoded master source document which is superimposed adjacent a transfer sheet. A magnetic toner is applied to the transfer sheet and selectively attracted thereto forming a magnetic toner image corresponding to the master source document. The toner image is then fused to the transfer sheet and machine read by a pick-up device which may be an optical or magnetic character recognition device. The signals from the pick-up device are transmitted to a computer.

In accordance with one aspect of the present invention, there is provided a printing machine of the type in which magnetically permeable marking particles develop a latent image recorded on a member. The improvement includes a read head positioned adjacent the member to detect magnetic field intensity effects produced by the marking particles developed on the member and, in response thereto, to generate a signal.

Pursuant to another aspect of the features of the present invention, there is provided an electrophotographic printing machine of the type in which a latent image recorded on a moving photoconductive member is developed with magnetically permeable toner particles. The improvement includes means, positioned adjacent the photoconductive member, for detecting magnetic field intensity effects produced by the toner particles developed on the photoconductive member. Means transmit a light beam onto the toner particles developed on the photoconductive member and sense the intensity of the light rays reflected therefrom. Means, responsive to the signal from the detecting means and the signal from the transmitting means, generate a control signal.

It is further desirable to closely control the magnetic developability of MICR printers in order to ensure quality of the output, thereby enabling reliable recognition by existing business machines. It has long been recognized that closed loop control of non-magnetic developability via an optical density measurement of the image developed in the photoreceptor provides an excellent tradeoff between cost and performance. This is true because of the relative stability of transfer and fusing processes and because by modulating one parameter such as toner concentration compensation for factors contributing to low copy quality such a photoreceptor dark decay and developer aging can be partially achieved. A primitive form of this optically based technique to control magnetic toner developments has proved to achieve some success but may not assure quality of the output. Users must rely on external commercial MICR readers to periodically verify its output documents which is a burdensome and costly process.

Since existing machines employ magnetic means to decode the MICR characters, it is highly desirable to use a xerographic process control scheme that is magnetically based in order to maximize correlation between the two. In particular, it is desirable to measure the magnetic line width and the magnetic magnitude of the lead and trail edge signals, dB/dT and −dB/dT, as these parameters are employed in many existing MICR reader. It is the purpose of this invention to provide a low cost sensor that will enable such control schemes through measurement of these quantities.

The sensor and its related signal processing system have several advantages over the prior art. For one toner consumption in the test patch area is lowered resulting in a lower contamination level in the machine and lower toner consumption overall. Another advantage is the quicker acquisition of the measurement, and the third is that the test pattern can be produced in a very much smaller space than those of the prior art.

Another feature of the invention is the ability to interrogate solid areas, whereas prior art devices are applicable only to a repetitive line pattern. Since commercial MICR readers use signals generated from the lead edge, trail edge, and interior of the MICR signal to identify the MICR character producing that signal, the present application by also interrogating these parameters will yield a measure of MICR signal "quality" that has a higher degree of correlation with commercial readers used by the banking and financial industries. Parameters of interest include lead edge and trail edge enhancement or attenuation, strobing, voids and other nonuniform toner deposition interior to the test patch that give rise to localized magnetic nonuniformities.

The present invention is more versatile than others, because it can measure the magnetic characteristics of MICR lines having various widths. Other prior art devices require a narrow band pass filter in its signal processing, which fixes the MICR line geometry at a prechosen configuration. The invention described herein provides the ability to measure line width, which is important in MICR process control as line width is a key parameter that needs to be controlled in order to print MICR characters that are recognizable by commercial readers.

The measurement scheme described in connection with the invention replicates to a high degree the way that commercial readers interrogate MICR documents. They both saturation magnetize the MICR material, produce a net permanent magnetization in the plane of the printed character, orient said magnetization with the "north pole" pointed in the direction of motion, and measure the resultant magnetic signal with a wide gap read head. The net effect of this commonality is to produce a reading of magnetic strength that correlates very closely to that produced with the commercial readers.

The implementation of a MICR sensor or printing machine requires many practical considerations, one of which is the degree of alignment existing between the MICR read head and the test pattern being measured. The goal of a low cost and reliable device is to be able to accurately measure the desired MICR parameters over a range of misalignments that one would normally expect to find in these machines. This is accomplished in the present invention as described in the Detailed Discussion of the Preferred Embodiment that follows.

The above has been a discussion of certain deficiencies in the prior art and advantages of the invention. Other advantages will be apparent to those skilled in the art from the discussion of certain embodiments that follow.

DETAILED DESCRIPTION OF THE PREFERRED EMBODIMENT

Figure 1B:
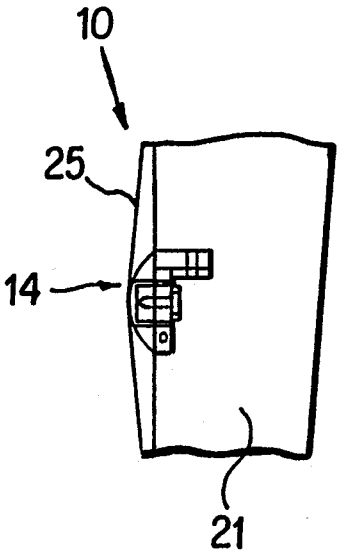
FIG. 1B is an end view of the invention as shown in FIG. 1A.
Figure 1A:
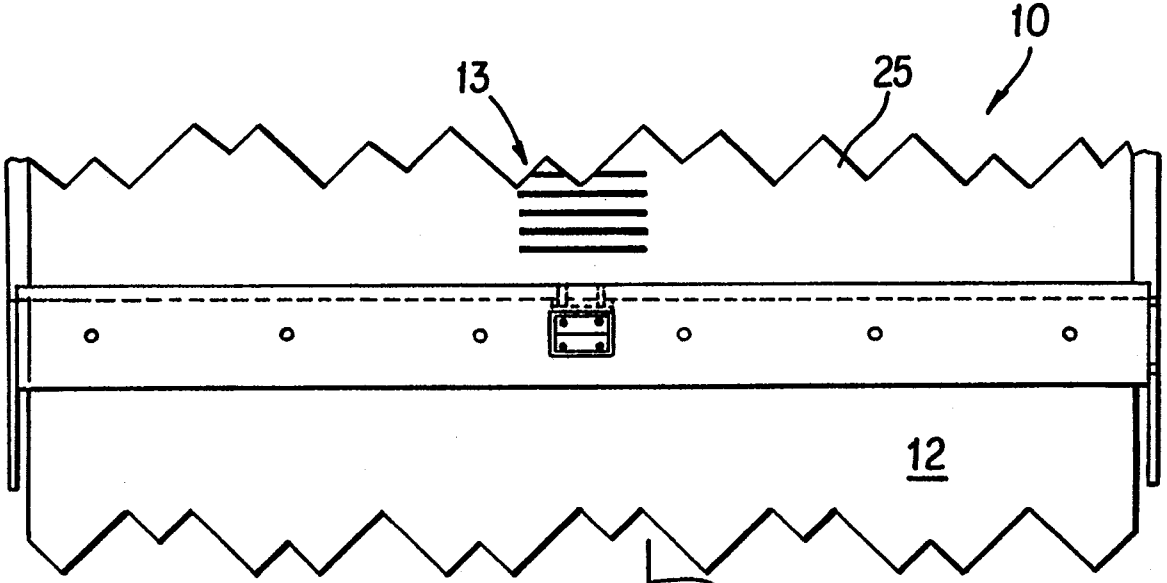
FIG. 1A is a schematic of the invention showing a plurality of lines of toner.
Figure 1C:
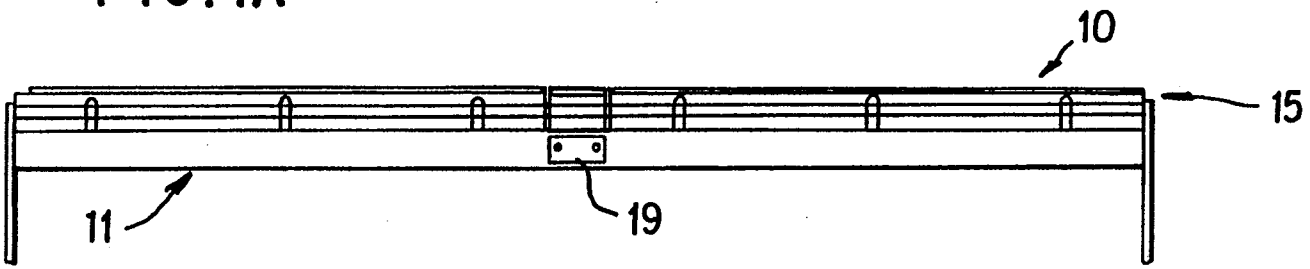
FIG. 1C is a front view of the invention as shown in FIG. 1A.

As can be seen in FIG. 1 there is shown a top view of a photoreceptor belt with the apparatus in place for sensing the magnetic intensity of characters. The assembly 10 includes a belt 12 shown moving in the direction of the arrow. The read head 14 is located beneath the belt 12 with the gap located inboard outboard with respect to the moving of photoreceptor. On the opposite of the photoreceptor where it is engaged by the magnetic head there is shown a test pattern of formed permeable toner particles having magnetic characteristics. As the belt is moved continuously along an endless path past the sensor, the sensor will sense each of the characters defining the test pattern as shown.

Not shown in the drawings is a system for magnetizing the toner particles. Any method of magnetizing the toner is satisfactory so long as there is sufficient magnetization for the desired purpose. An example of an apparatus that includes adequate toner magnetization means is U.S. Pat. No. 4,563,086 incorporated herein in its entirety by reference.

Figure 2:
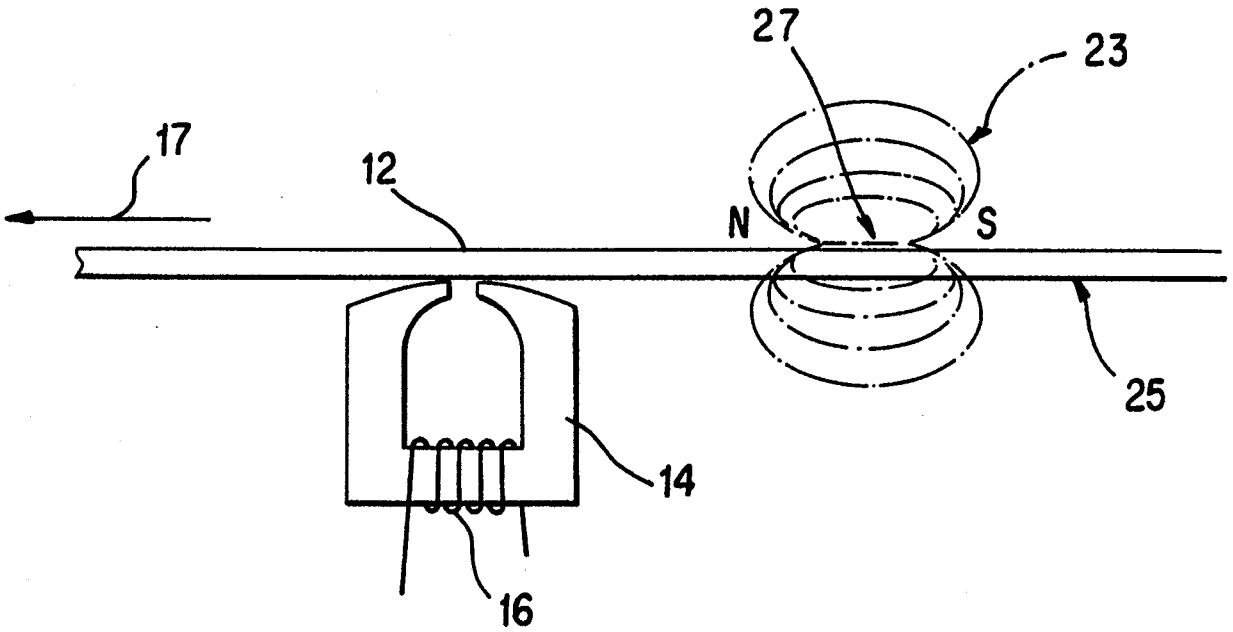
FIG. 2 is a schematic of the magnetic tape head engaging the photoreceptor belt.

As can be seen in FIG. 2 where there is an enlarged schematic showing the magnetic read head engaging the undersurface of the photoreceptor, it can be seen how the magnetic toner particles generate magnetic flux lines. The tape head is energized by a significant rise in the magnetic toner by the magnetic flux imposed by the toner particles and a drop at the end of the character as shown. A signal coil 16 cooperates with the magnetic read head to deliver a signal corresponding to the intensity of the magnetic field sensed, particularly at the leading and trailing edges of character.

Figure 3:
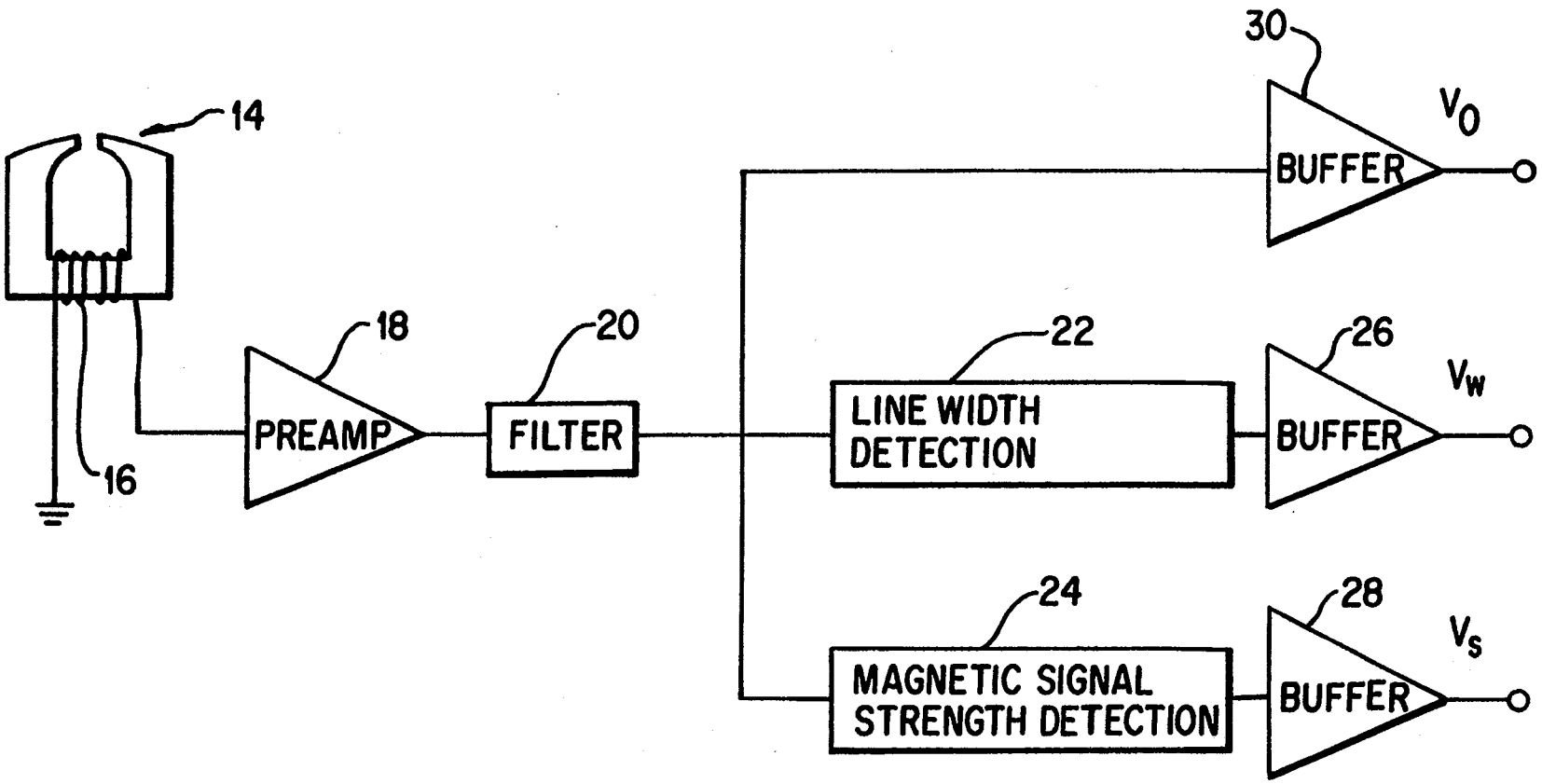
FIG. 3 is a block diagram of the signal processing circuit that forms the invention.

As can be seen in FIG. 3, one end of the signal coil is attached to ground while the other end is connected to a preamplifier 18 and filter 20 before being connected downstream with a line width detection 22 in parallel with the magnetic signal strength detection 24 system. Downstream of each of the line width detection module and the magnetic signal strength detection module are buffers 26 and 28. The signal strength can be measured at a voltage $V_S$ with the width detection measured by voltage $V_W$. Parallel with this is buffer 30 connected to the filtered preamp output voltage designated by V0. In this way the lead signal is measured as dB/dT and the trailing signal as −dB/dT.

Figure 4:
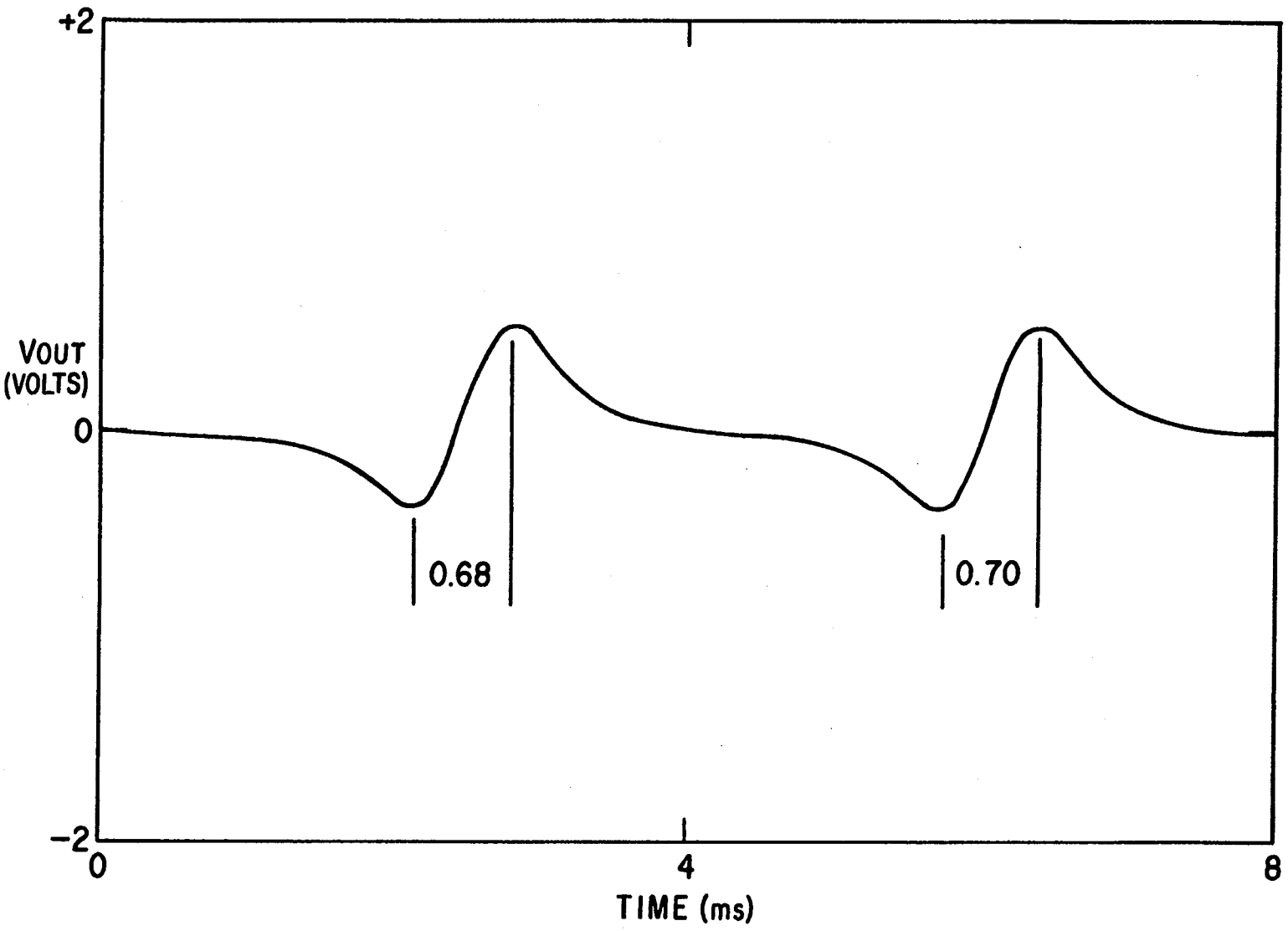
FIGS. 4, 5, 6 and 7 show respectively the sensor response to pairs of 2, 4, 6 and 8 pixel wide xerographic lines developed on an organic film photoreceptor that is typical of those used in commercial copy machines.
Figure 5:
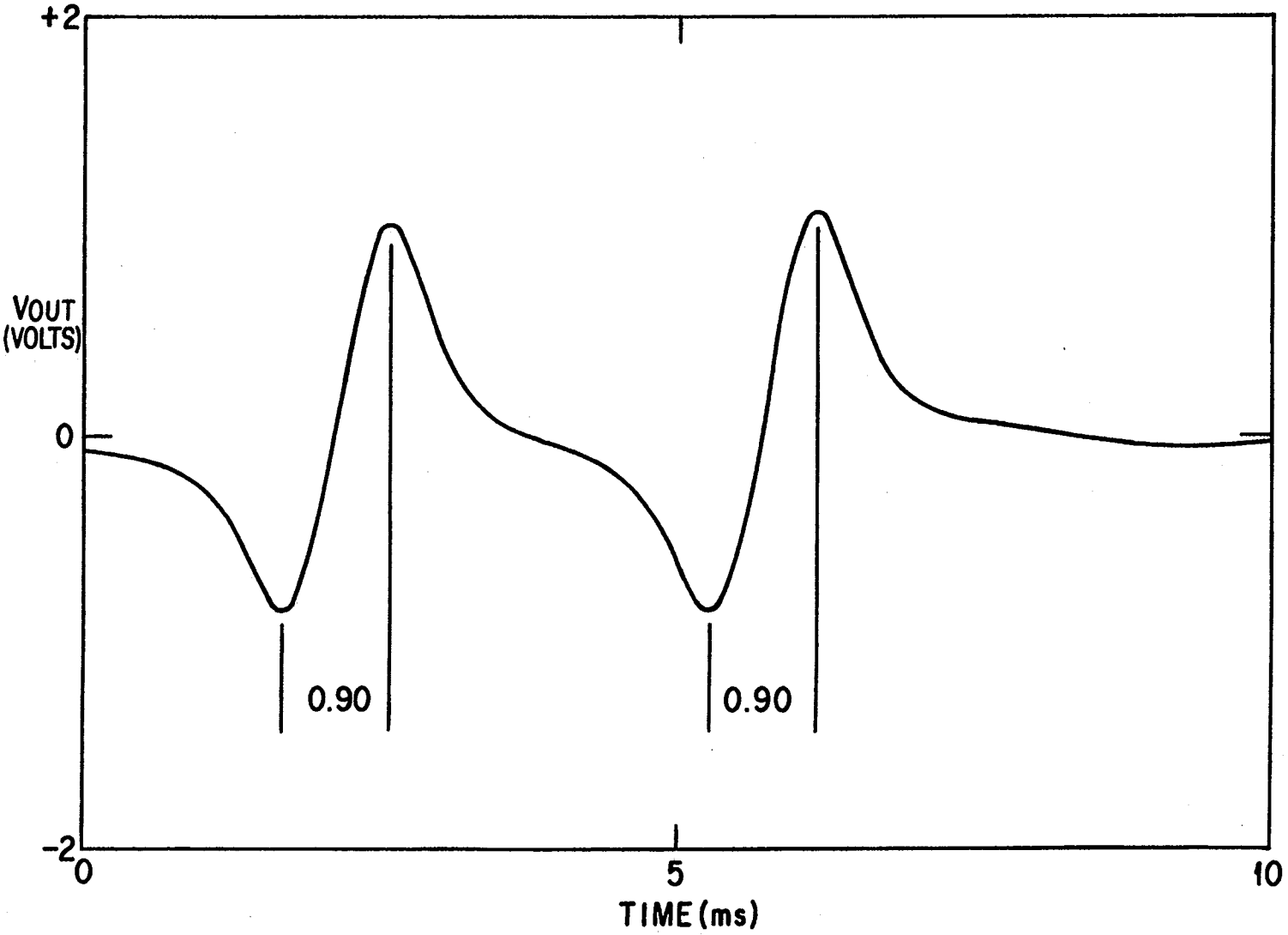
Figure 6:
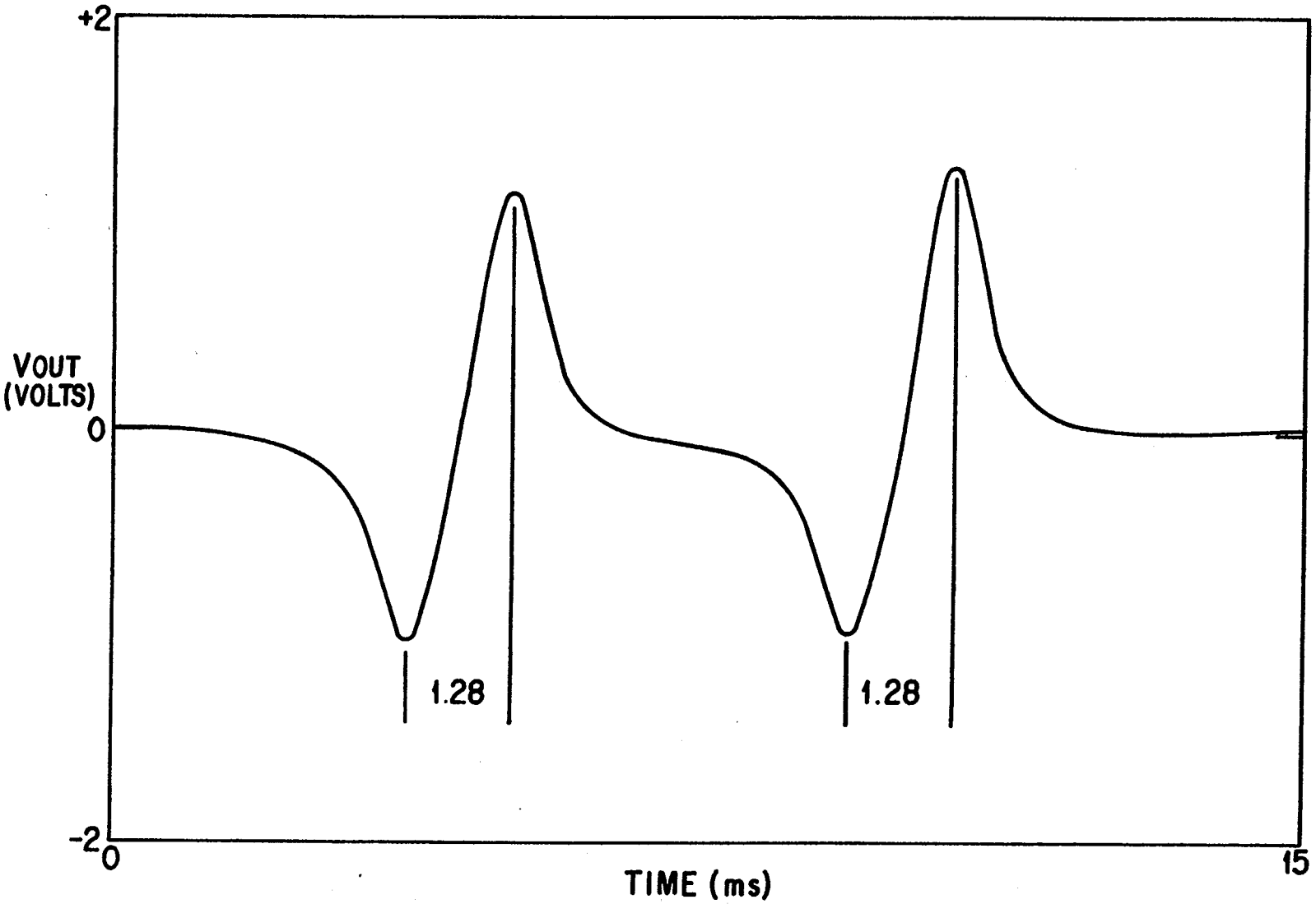
Figure 7:
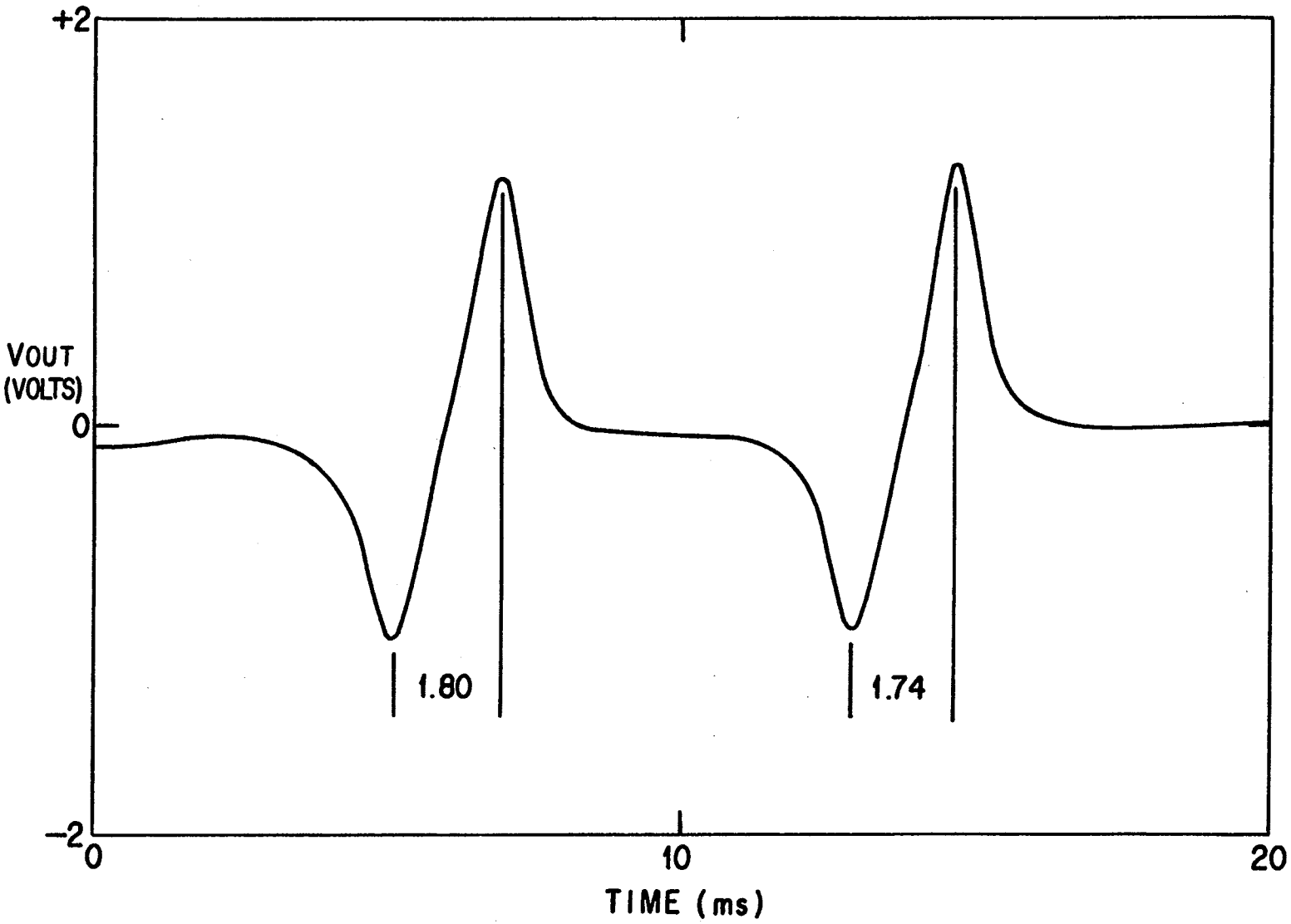

FIGS. 4, 5, 6 and 7 show respectively the sense of response to various graphic lines developed on a typical organic film photoreceptor. As can be seen in FIG. 4 the voltage change at the leading edge of characters characterized by having 2 pixels on and 10 off while the substrate is moving at 15" per second. It can be seen that initially the voltage is raised by about 0.50 volt. As the number of pixels are increased, i.e. when wider lines are used, as can be seen in FIGS. 5, 6 and 7 the voltage differential is increased with a greater time period between the lowest voltage and the highest.

Figure 8:
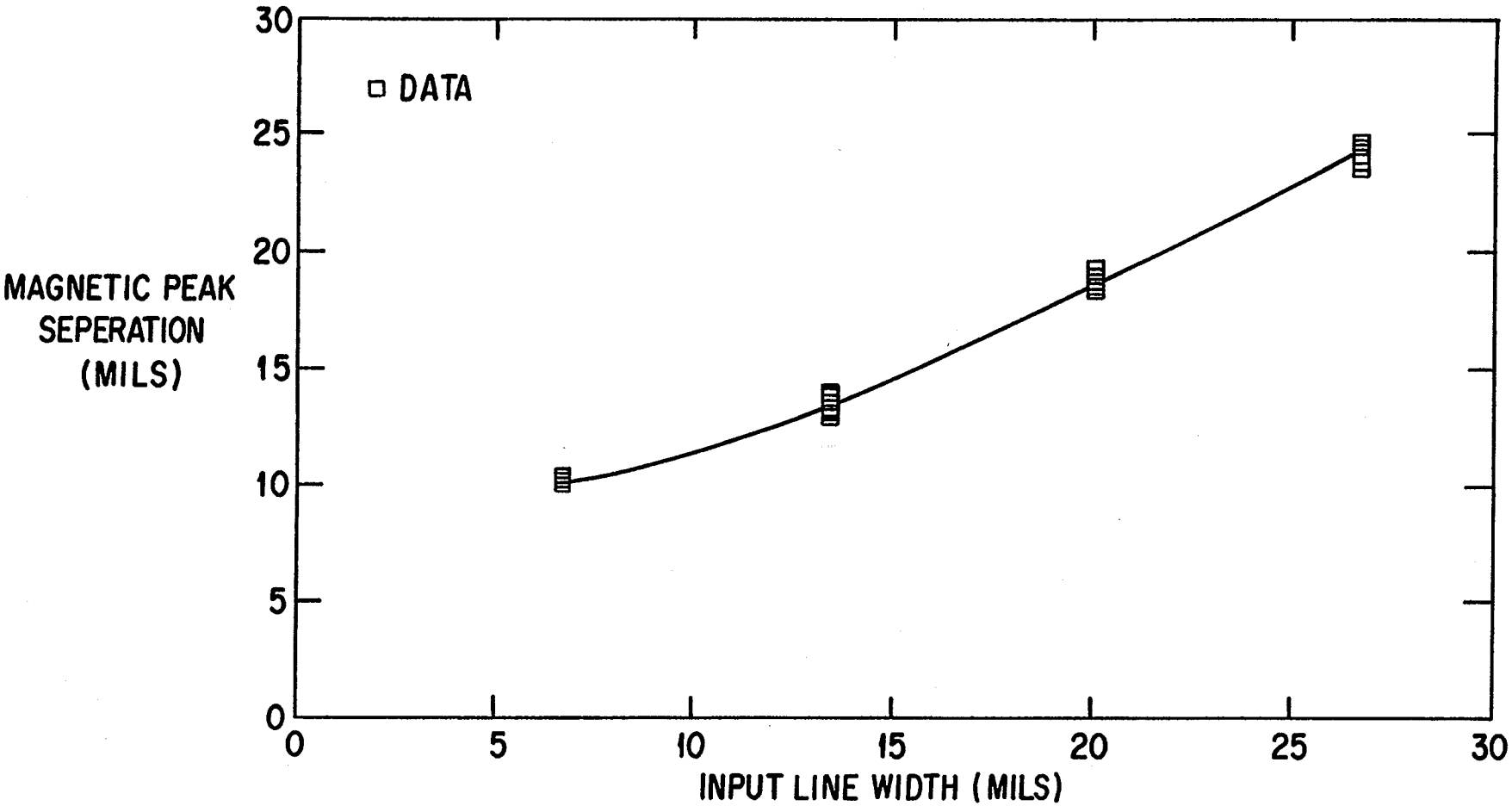
FIG. 8 is a graph showing the relationship between the input line width and a spacial separation of the plus and minus peaks of the sensor response.

FIG. 8 shows the relationship between the input line width in mils and a spacial separation of the plus and minus peaks of the output signal. As expected the deviation from a normally linear relationship occurs when the line width approaches the photoreceptor thickness which is about 5 mils.

Figure 9:
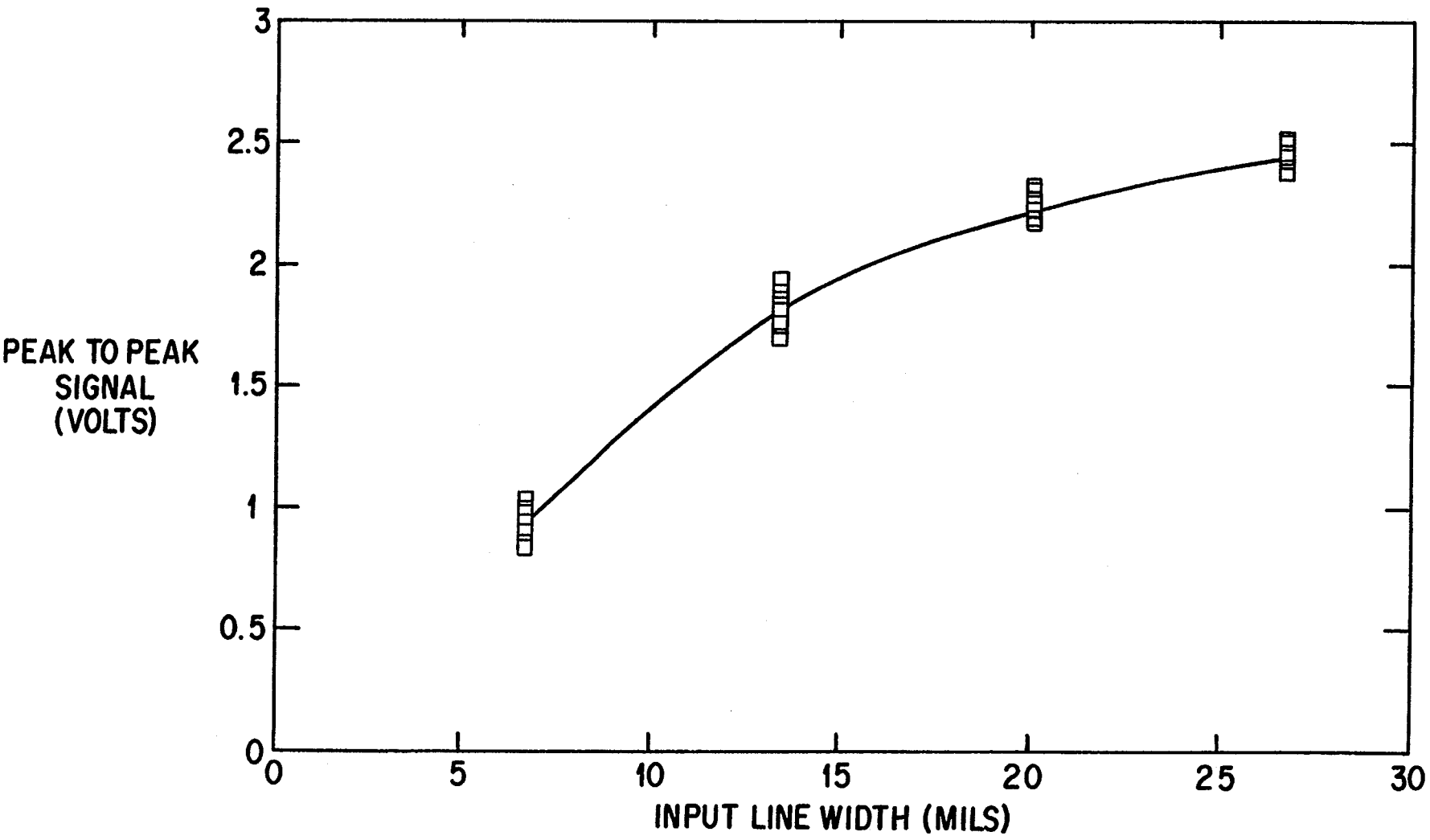
FIG. 9 is a graph showing the relationship between input line width and peak-to-peak amplitude of the sensor response.

FIG. 9 summarizes the relationship between the input line width and the peak-to-peak amplitude of the waveforms. As would be expected there is a monitonically increasing relationship between the line width and the measured field strength which is due to the existence of a greater number of the magnetic particles developed onto the wider lines.

Figure 10:
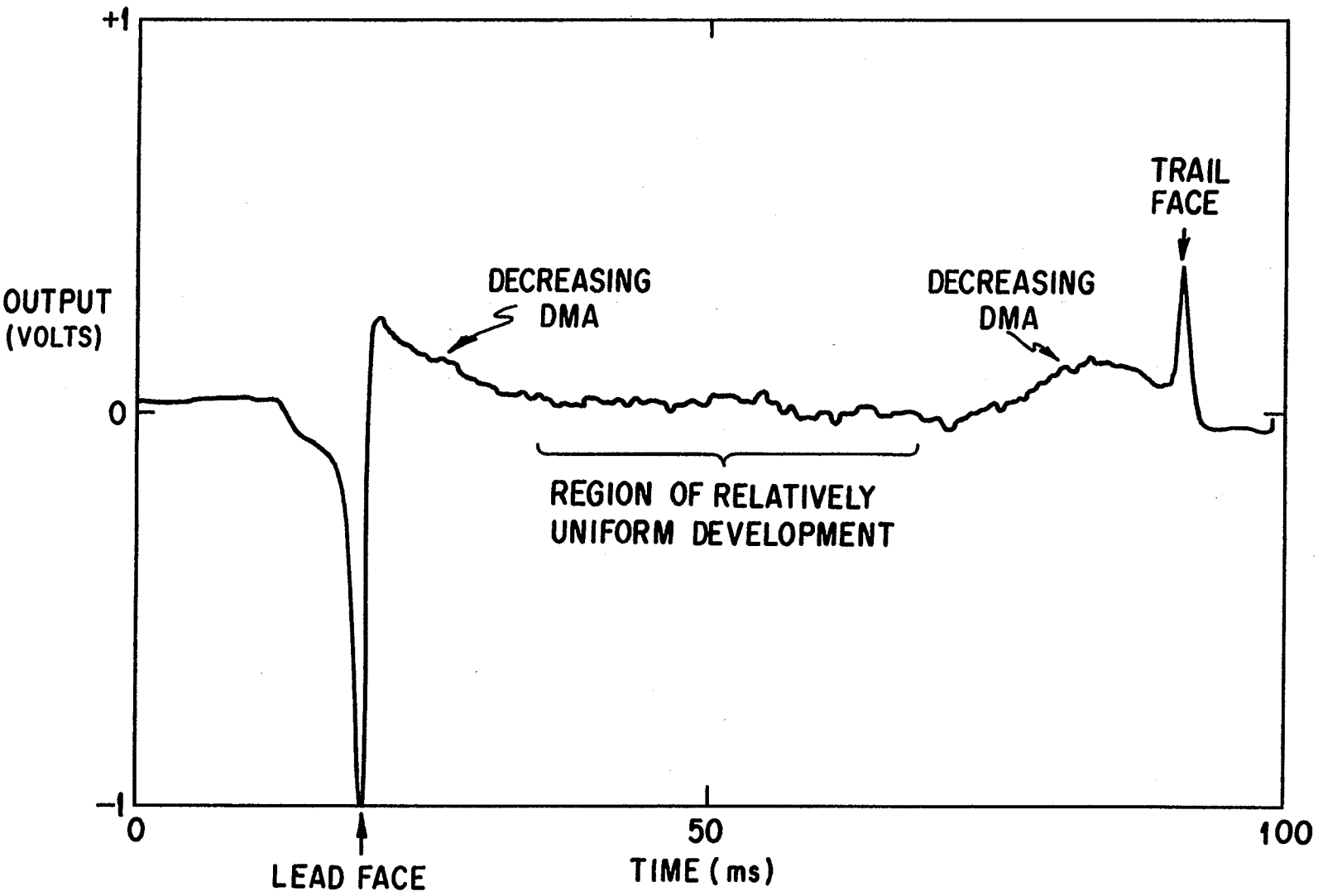
FIG. 10 shows the output when scanning a solid area test patch of toner.

FIG. 10 shows the output when one is scanning a solid area of about 25.4 millimeters in length. It can be seen that the central region between the leading edge and the trailing edge are as a relatively uniform development. Whereas in the regions between this central region and the lead and trail edges, there exist regions of relatively non uniform development.

Figure 11:
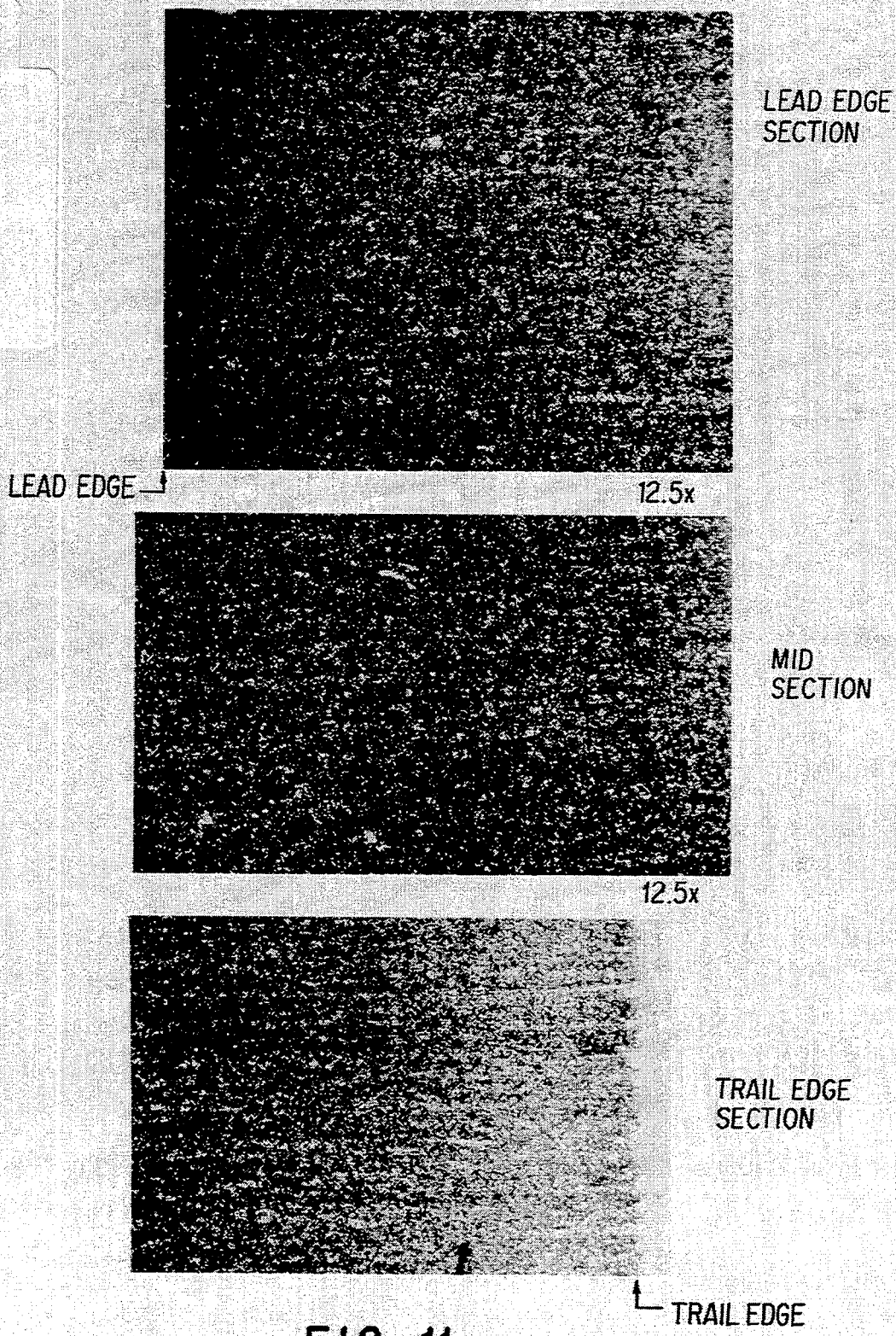
FIG. 11 is a photograph of selected portions of that same solid area test patch.

FIG. 11 photograph of selected portions of the same developed patch is shown. As can be seen from these photographs both the sensor output and the photographs show enhanced lead edge development and depleted trail edge development and relatively uniformed development to the interior path. Thus, even though the device will probably be used primarily in reading and controlling lines it can provide information with regard to solid developability as well.

Figure 12:
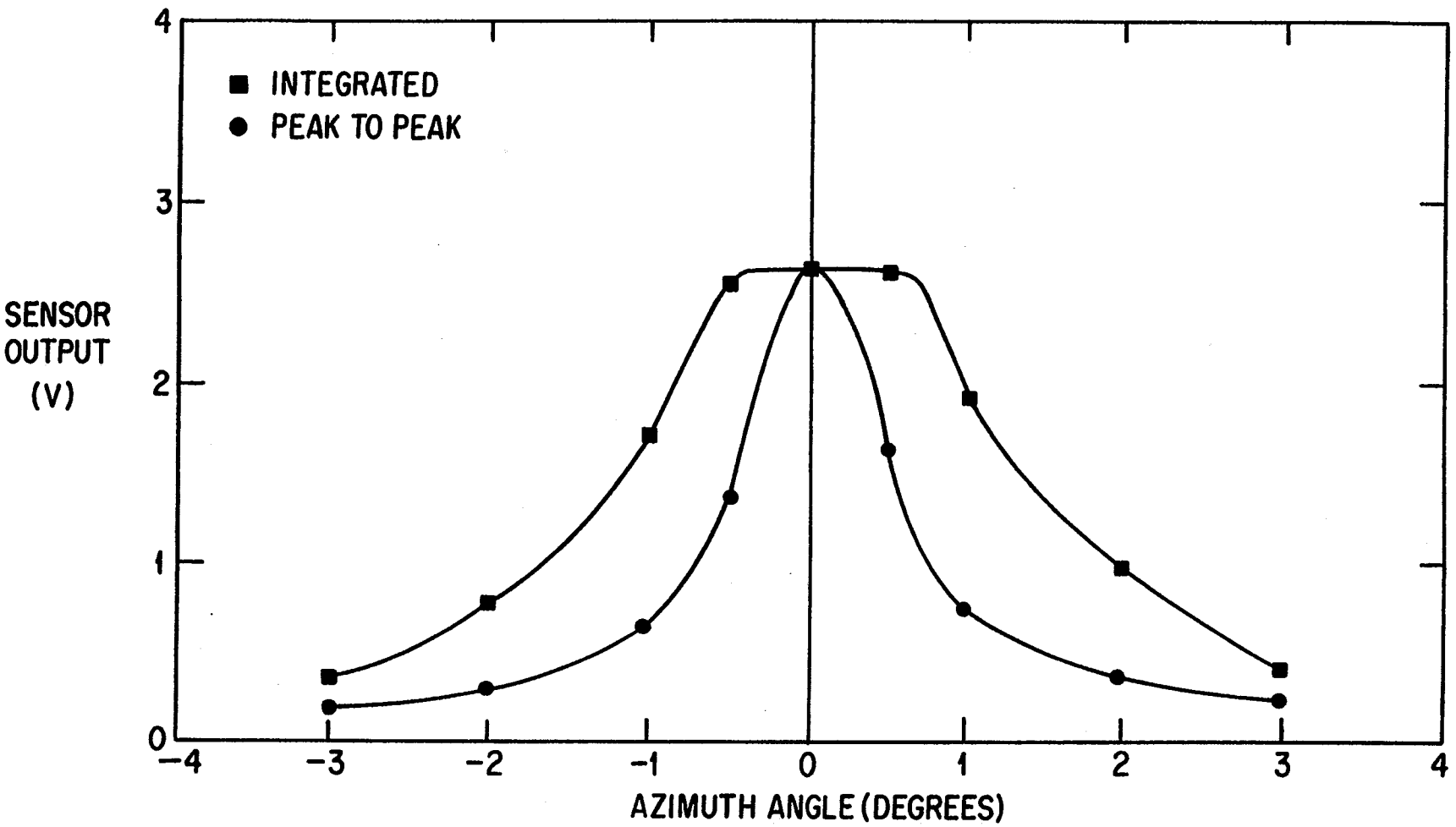
FIG. 12 shows the relationship of sensor output to azimuth angle for 0.1 inch gap.
Figure 14:
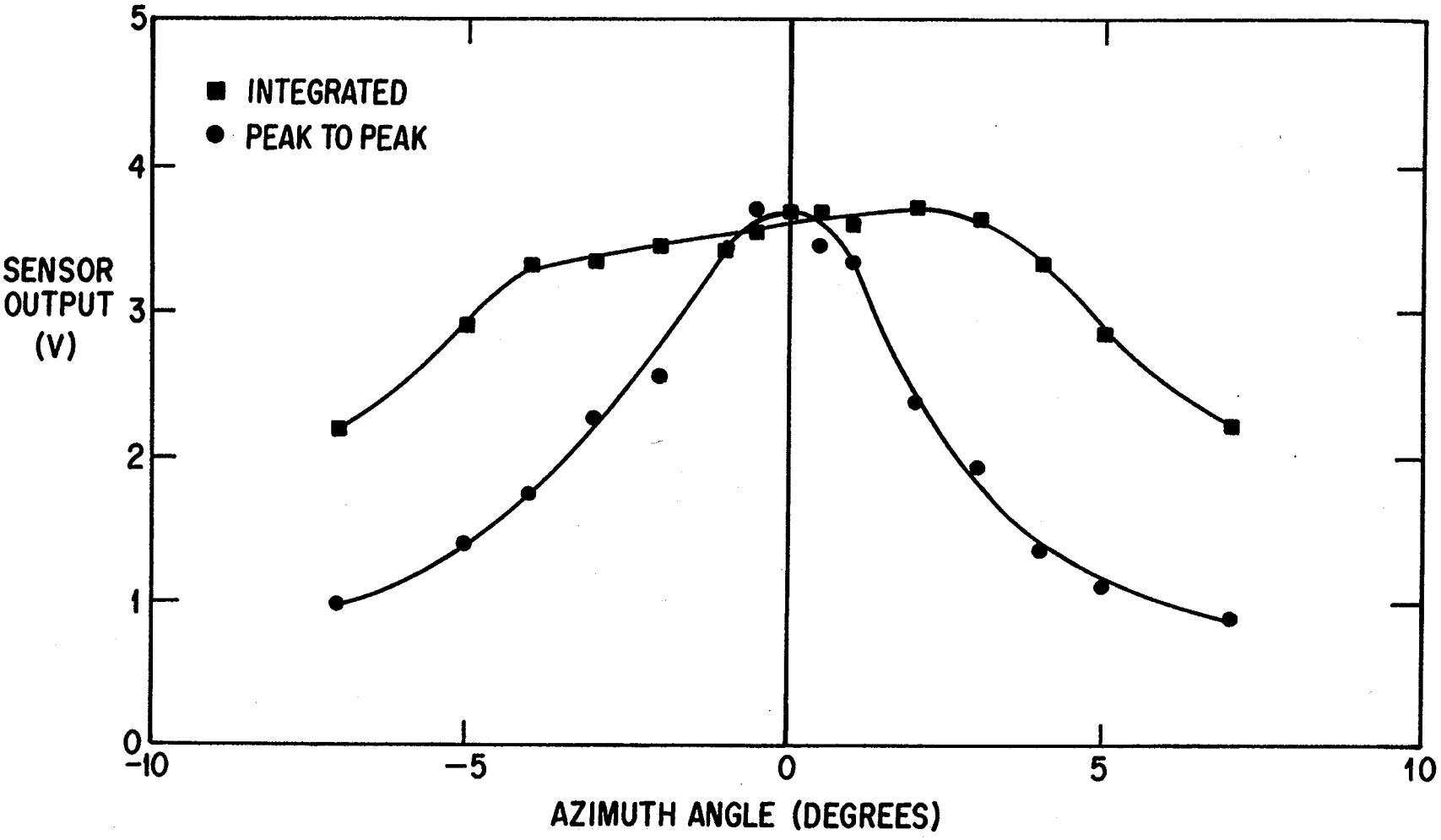
FIGS. 14, 15 and 16 are graphs of peak signal behavior and the integrated signal behavior.
Figure 15:
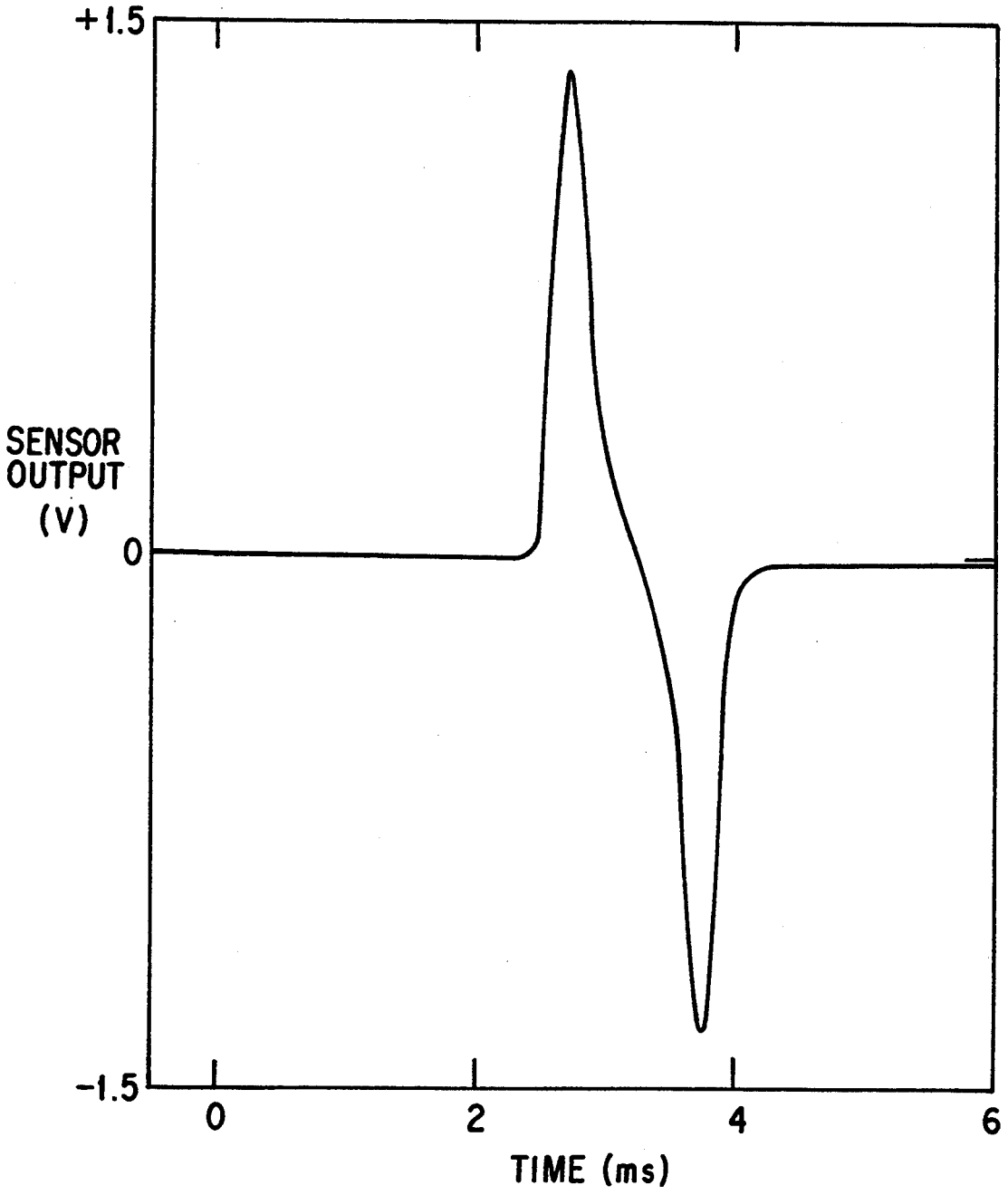
Figure 16:
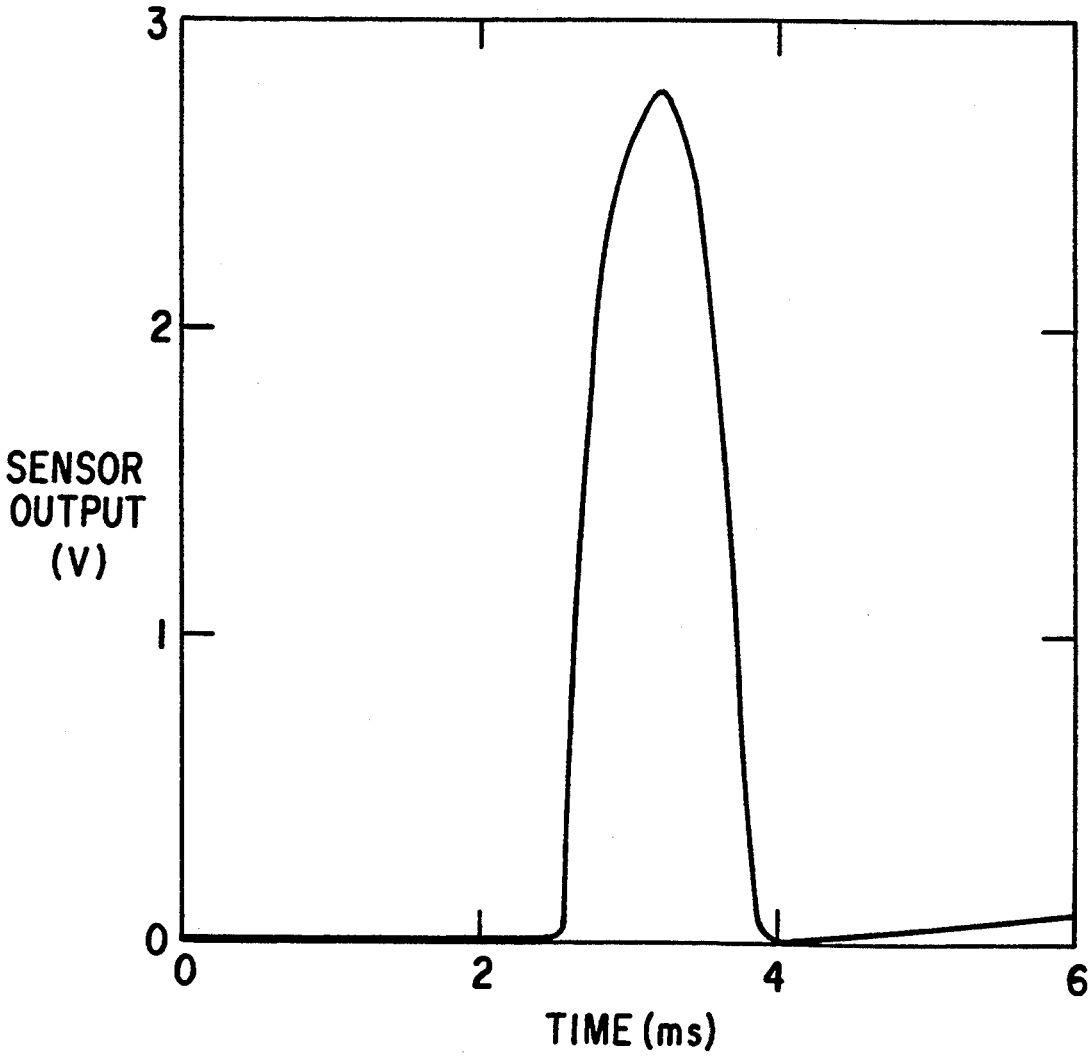

The read head is specially configured to achieve the goals of the invention. The length of the read head gap is reduced to 0.1" from the 0.5" to 1.0" length commonly found in existing, commercially available MICR read heads With this length, 0.1" the sensor can tolerate ±0.8 degrees of azimuth misalignment as opposed to less than ±0.2 degrees with a commercially available read head. A comparison between FIGS. 12 and 14 shows the increase graphically.

Figure 13:
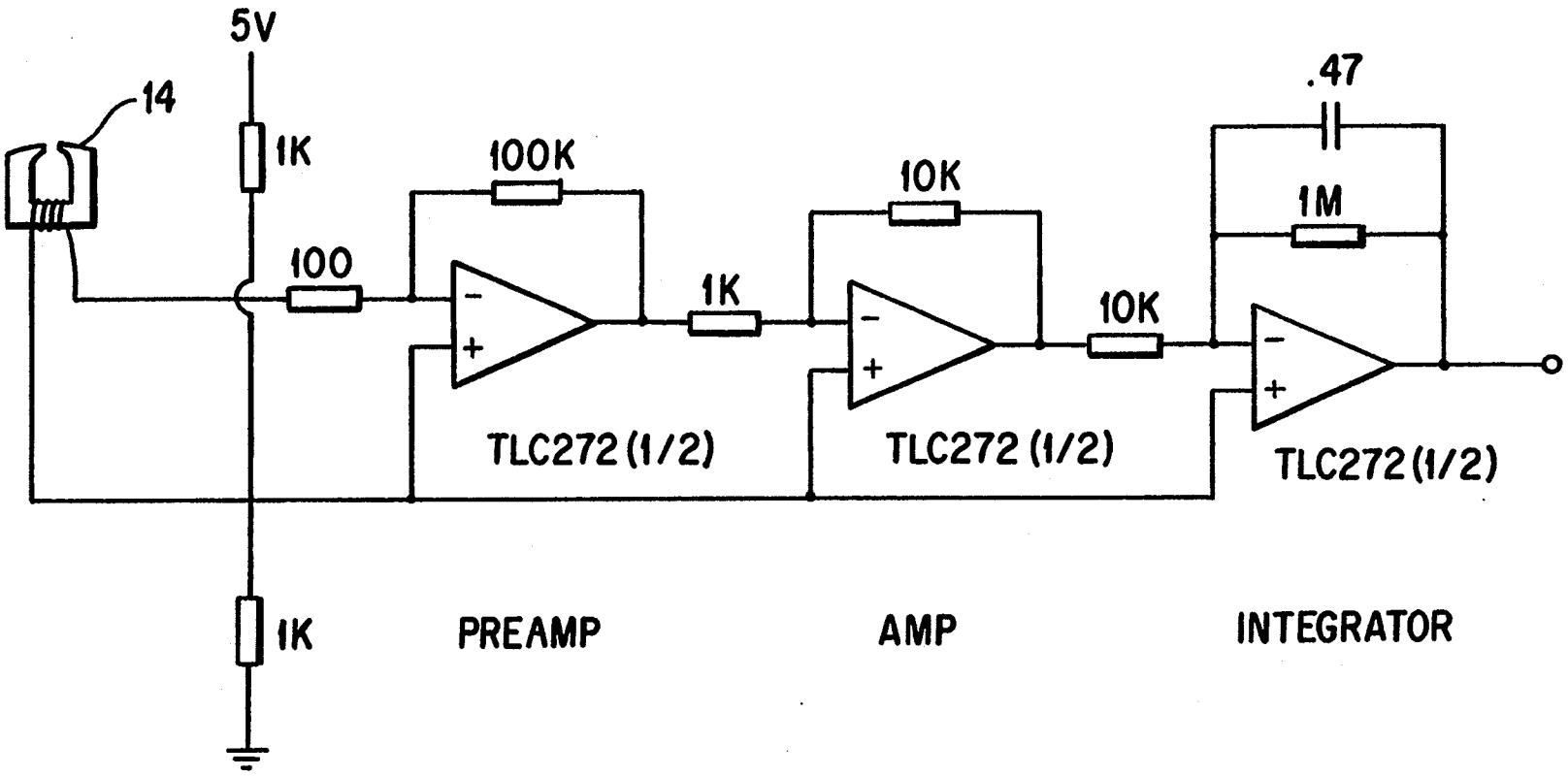
FIG. 13 shows an alternative circuit for processing a signal from the read head.

Another circuit arrangement used with the read head of the invention is shown in FIG. 13. Here the signal from the read head is integrated, and this further extends the amount of misalignment that can be tolerated. FIG. 13 shows an example of an integrating stage appended to the amplification stages used to prove the concept. With the peak of the integrated signal as the MICR magnetic strength metric, tolerance to azimuth misalignment is extended from ±0.8 degrees to ±3.5 degrees, which is sufficient to enable low cost sense heads to be fabricated, installed in a typical printer, and successfully operated without the secondary operation of aligning the device once it has been installed. The effect is shown graphically in FIG. 14, wherein the peak signal behavior and the integrated are compared as a function of the azimuth misalignment.

With this system one can continually monitor the quality of the toner image and control operation of the printer or copier accordingly. One skilled in the art would appreciate that where the test pattern demonstrates that the toner quality is insufficient, various processing stations can be controlled to compensate for the toner replaced until the image is satisfactory.

What is claimed is:

1. A printing machine of a type in which magnetically permeable marking particles develop a latent image of a character recorded on a member comprising:

(a) means for moving said member along a closed path;

(b) means for forming characters with said magnetic permeable marking particles on said member;

(c) means for saturization magnetization of said characters;

(d) read head positioned adjacent the member to detect a magnetic signal from a single one of said characters and;

an integrator electrically coupled to said read head for integrating said signal.

2. The apparatus according to claim 1 further comprising a line detection system and a magnetic signal strength detection system electrically coupled to said read head via said integrator.

3. The apparatus according to claim 2 wherein said member includes an upper side and a lower side, said magnetic characters being formed on said upper side, said read head being located adjacent said member on said lower side thereof.

4. The apparatus according to claim 3 wherein said read head engages said lower surface of said member.

5. The apparatus according to claim 4 wherein said read head defines a read gap aligned inboard, outboard.

6. The apparatus according to claim 5 wherein said member is a photoreceptor for use in a xerographic printing machine.

7. The apparatus according to claim 1 wherein said read head has a read head gap of approximately 0.1 inches in length.

8. The apparatus according to claim 1 wherein said read head detects a magnetic signal from an interior portion of a solid area of developed, magnetically permeable marking particles.

* * * * *

UNITED STATES PATENT AND TRADEMARK OFFICE

CERTIFICATE OF CORRECTION

PATENT NO. : 5,341,193
DATED : August 23, 1994
INVENTOR(S) : Fred F. Hubble, III, et al It is certified that error appears in the above-indentified patent and that said Letters Patent is hereby corrected as shown below:

| Column | Line | |
|---|---|---|
| 3 | 40 | Change "a" to --as--. |
| 3 | 56 | Change "reader." to --readers.--. |
| 4 | 16 | Change "its" to --their--. |
| 5 | 25 | Change "inboard outboard" to --inboard and outboard--. |
| 6 | 15 | Change "monitonically" to --monotonically--. |
| 6 | 23 | Change "are" to --is--. |
| 6 | 27 | After "11" insert --is a--; change "of" (first occurrence) to --in which--. |
| 6 | 28 | Change "is" to --are--. |
| 6 | 31-32 | Change "uniformed" to --uniform--. |
| 6 | 59 | change "integrated" to --integration--. |

Signed and Sealed this

Fourth Day of April, 1995

*Attest:*

Bruce Lehman

BRUCE LEHMAN

*Attesting Officer*

*Commissioner of Patents and Trademarks*